US006659410B1

(12) United States Patent
Lu

(10) Patent No.: US 6,659,410 B1
(45) Date of Patent: Dec. 9, 2003

(54) LEG OF A METALLIC TABLE

(76) Inventor: Jin-Chu Lu, 6F, No. 59, Jiu Gong St., Lu Zhou Shi, Taipei Hsien (TW)

( * ) Notice: Subject to any disclaimer, the term of this patent is extended or adjusted under 35 U.S.C. 154(b) by 0 days.

(21) Appl. No.: 10/252,704

(22) Filed: Sep. 24, 2002

(51) Int. Cl.[7] ..... F16M 11/16
(52) U.S. Cl. ..... 248/188; 108/147.13; 108/192
(58) Field of Search ..... 248/188; 108/157.1, 108/157.17, 147.13, 147.14, 147.15, 192, 193; 403/187, 188, 192, 195, 367, 368, 369, 340, 289, 188.1

(56) References Cited

U.S. PATENT DOCUMENTS

| | | | | | |
|---|---|---|---|---|---|
| 2,755,114 | A | * | 7/1956 | Becker | 403/361 |
| 3,263,630 | A | * | 8/1966 | Carlson | 108/158 |
| 3,957,239 | A | * | 5/1976 | Slaats et al. | 248/188 |
| 3,957,381 | A | * | 5/1976 | Schafer | 403/16 |
| 4,318,352 | A | * | 3/1982 | Friedman et al. | 108/107 |
| 4,656,952 | A | * | 4/1987 | Schweizer | 108/11 |
| 4,852,837 | A | * | 8/1989 | Merten et al. | 248/188 |
| 4,925,140 | A | * | 5/1990 | Camarota | 248/188 |
| 5,026,010 | A | * | 6/1991 | Camarota | 248/188.1 |
| 5,230,491 | A | * | 7/1993 | Tseng | 248/188.1 |
| 5,528,996 | A | * | 6/1996 | Edwards et al. | 108/64 |
| 6,048,127 | A | * | 4/2000 | Kern et al. | 70/45 |
| 6,079,575 | A | * | 6/2000 | Wang | 211/187 |
| 6,357,611 | B1 | * | 3/2002 | Chen | 211/187 |
| 6,511,034 | B2 | * | 1/2003 | Nicholson et al. | 248/523 |

FOREIGN PATENT DOCUMENTS

| | | | | |
|---|---|---|---|---|
| GB | 2 035 069 | A | * 10/1979 | A47B/13/08 |

* cited by examiner

*Primary Examiner*—Ramon O. Ramirez
*Assistant Examiner*—Amy J. Sterling
(74) *Attorney, Agent, or Firm*—Rosenberg, Klein & Lee

(57) ABSTRACT

A leg of a table includes a connecting portion, and an elongated supporting portion. The connecting portion includes two lateral plates secured to bottom of a table's top, and several horizontal portions formed between the lateral plates. The horizontal portions have through holes aligned with each other. Annular walls are formed around the through holes. The annular walls are shaped such that the inner sides thereof taper off towards an upper end of the inner side of the uppermost one. The elongated supporting portion has pads on an upper end, of which the outer sides taper off towards an upper end. The elongated supporting portion is joined to the connecting portion with the pads being inserted into the annular walls; thus, the pads will be forced further into the connecting portion when more weight is placed on the table, making the table more steady.

4 Claims, 4 Drawing Sheets

LEG OF A METALLIC TABLE

BACKGROUND OF THE INVENTION

1. Field of the Invention

The present invention relates to a leg of a metallic table. More specifically, the present invention relates to a leg, which is connected to the top portion of a table in such a manner that the firmness and stability of the table increases when more weight is placed on the top portion.

2. Brief Description of the Prior Art

Tables are important furniture in our houses, and indispensable tools in offices and factories. Tables should be as stable and strong as possible. And, stability and firmness of a table depends greatly on the way the legs are connected to the top portion of the table.

Referring to FIG. 4, a conventional metallic table includes legs 22, and a top portion, which is formed with bent around edges 211, and connecting portions 21 near to the edges 211.

Each of the connecting portions 21 has a support 212, a connecting plate 213, and a hollow connecting member 214 fitted thereto. The support 212 has two lateral plate portions. Each of the lateral plate portions of the support 212 is folded at two ends thereof. The lateral plate portions are respectively joined to bottom sides 2111, and 2121 of the top portion of the table at upper end portions thereof by means of welding; thus, a space is provided between both of the lateral plate portions. The bent around edge 211 is joined to the lower end of the corresponding lateral plate portion by means of welding. The connecting plate 213 is joined to inner sides of the lateral plate portions at the edges by means of welding. The hollow connecting member 214 has a central through hole 2122, and a screw hole 2141, and is firmly disposed between the lateral plate portions of the support 212 and under the connecting plate 213, and firmly joined to the same by means of welding.

In combination, the leg 22 is inserted into the through hole 2122 of the hollow connecting member 214 with the top thereof coming into contact with the connecting plate 213, and a bolt 2142 is screwed into the screw hole 2141 to secure the leg 22 to the hollow connecting member 214. Thus, the table can be used with all of the legs being fitted to top portion thereof to support the same in a level position.

However, the table has disadvantages as followings:

1. Because the tops of the legs 22 contact the bottoms of the connecting plates 213, most of the weight of the table's top portion and the objects on the table is supported by the connecting plates 213. Consequently, the table is not strong enough.
2. When a lot of weight is supported on the table to cause the bolts 2142 to loosen, the table is likely to become unstable.

SUMMARY OF THE INVENTION

It is a main object of the present invention to provide a leg, which is connected to the top portion of a table in such a manner that the firmness and stability of the table increases when more weight is placed on the table's top portion.

It is another object of the present invention to provide a metallic table with increased strength.

The leg of a table according to the present invention includes a connecting portion, and an elongated supporting rod portion. The connecting portion includes two lateral plates, and two horizontal portions formed between the lateral plates. The lateral plates are secured to the bottom of a table's top at the upper ends thereof. Each of the horizontal portions has a through hole. The through-holes are aligned with each other, and have annular walls formed around them.

The annular walls are shaped such that the inner sides thereof taper off towards an upper end of the upper one. The elongated supporting portion has two pads fitted around an upper end thereof, the pads have protruding lines on inner sides to be fitted to an annular trench formed on the upper end of the elongated supporting rod portion. The elongated supporting rod portion is joined to the connecting portion with the pads being inserted into the annular walls. The pads are shaped in such a manner that the outer sides thereof taper off towards an upper end thereof; thus, the pads will be forced further into the connecting portion when more weight is placed on the table.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
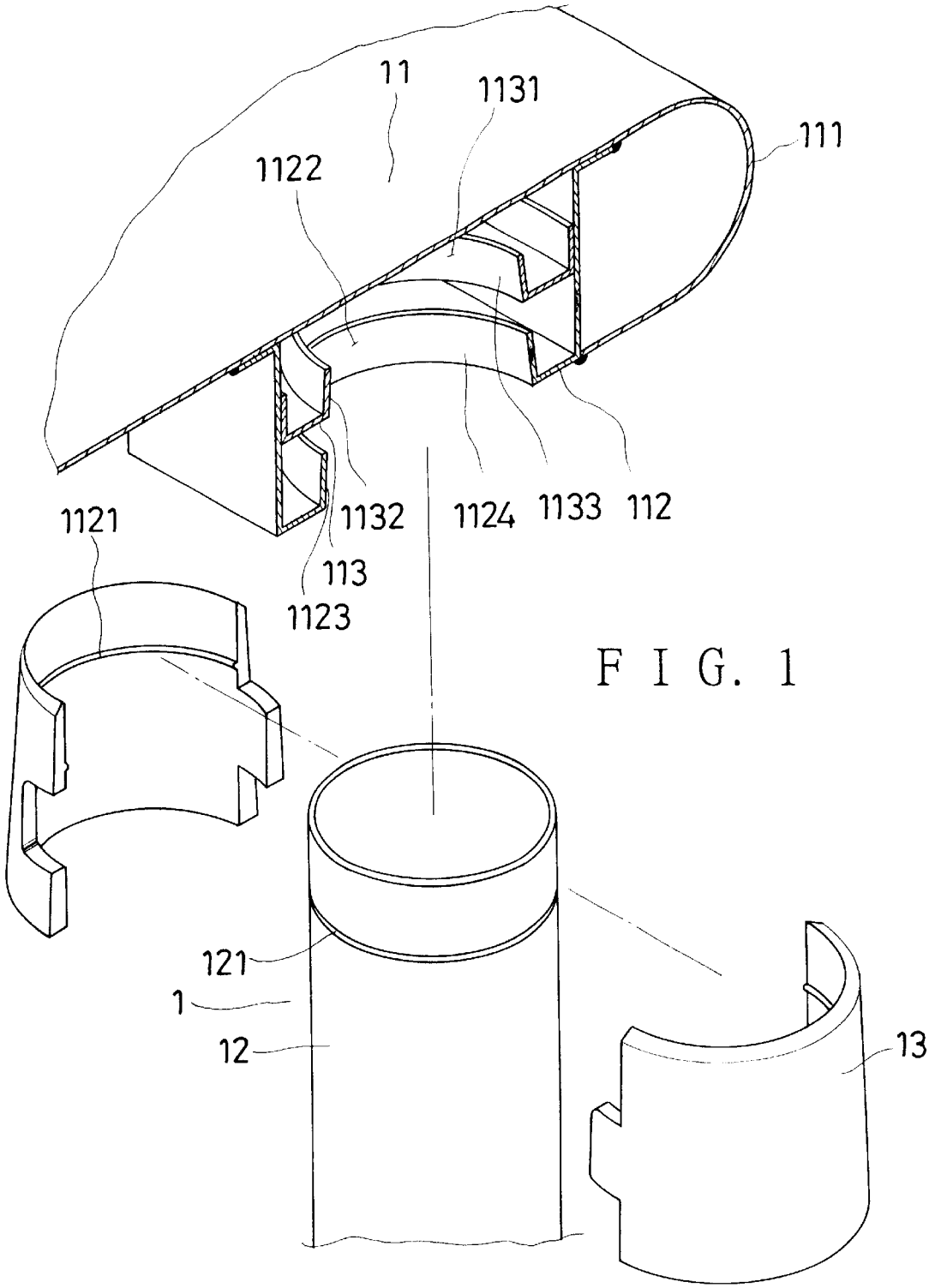
FIG. 1 is an exploded perspective view of the leg of a table according to the present invention.

Referring to FIG. 1, a leg 1 of a metallic table according to the present invention includes a connecting portion 11, and an elongated supporting portion 12. The metallic table consists of a top portion, and several (usually three or four) legs of such kind. The top portion of the table has edges 111, which are bent around.

The connecting portion 11 includes a support 112, and a connecting unit 113. The support 112 has two lateral plate portions, and a horizontal portion. Each of the lateral plate portions has a folded upper end portion, which is fixedly joined to a bottom side of the top portion of the table near to the bent around edge 111 by means of welding. The horizontal portion is formed between lower ends of the lateral plate portions, and has a first through hole 1122. A first annular wall 1123 is formed around the first through hole 1122.

The connecting unit 113 is disposed between, and securely joined to, the lateral plate portions and above the horizontal portion of the support 112; welding can be used for joining the connecting unit 113 to the lateral plate portions. The connecting unit 113 has a second through hole 1131, which is aligned with the first through hole 1122.

Figure 2:
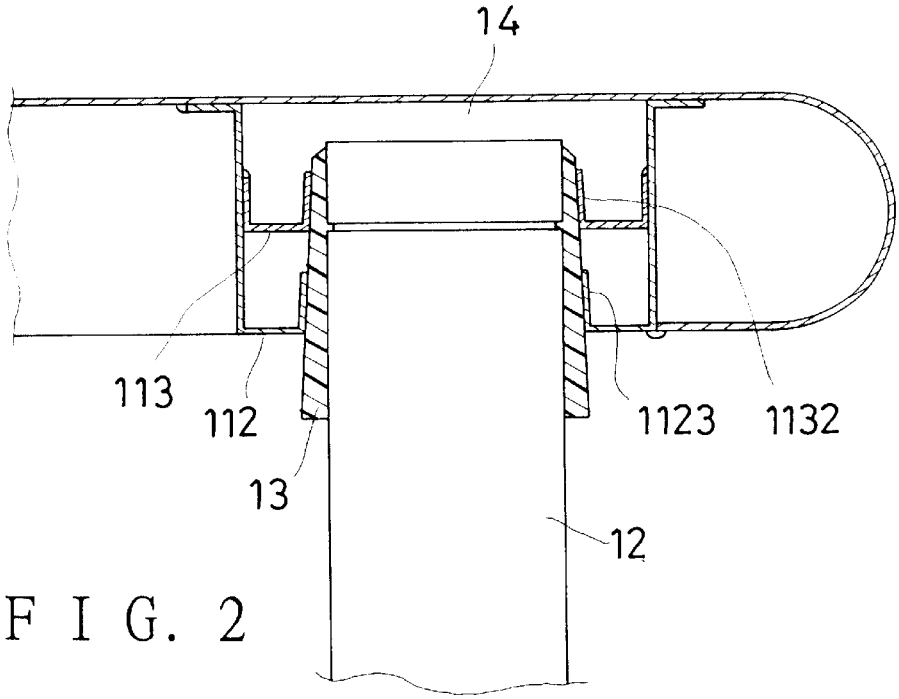
FIG. 2 is a cross-sectional view of the leg of a table according to the present invention.
Figure 5:
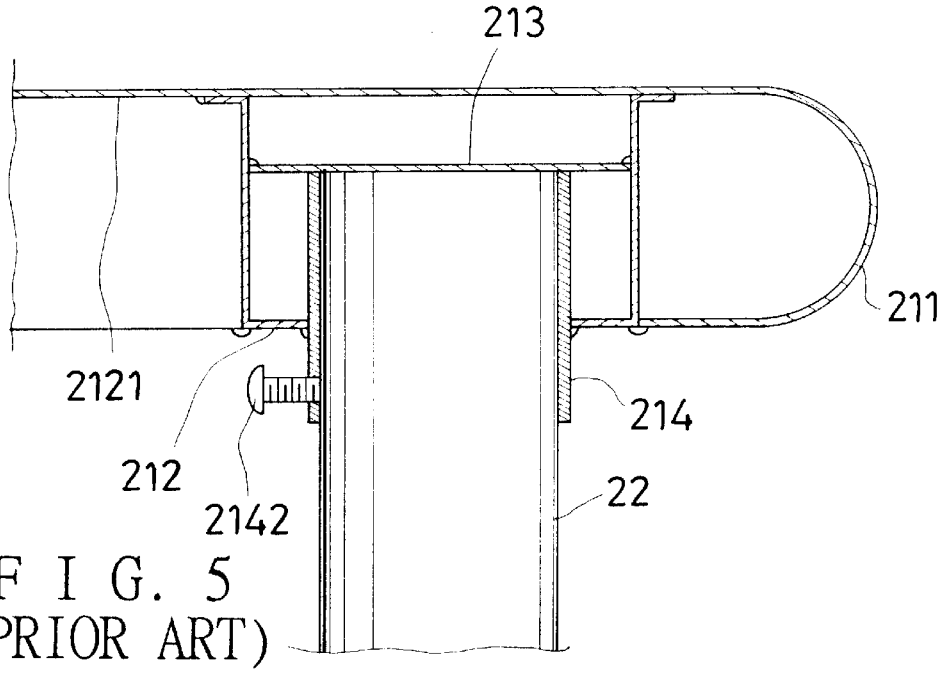
F I G. 5 (PRIOR ART)

A second annular wall 1132 is formed around the second through hole 1131. Referring to FIG. 2, the first and the second annular walls 1123, 1132 are shaped in such a manner that the inner sides thereof taper off towards an upper end of the second annular wall 1132.

The elongated supporting portion 12 has an annular trench 121 on an upper end thereof. Two pads 13 are fitted onto the upper end of the elongated supporting portion 12. Each of the pads 3 has a protruding line 131 on an inner side thereof, which is fitted into the annular trench 121 so that the pads 3 cannot slide along the elongated supporting portion 12. The pads 3 have projections, and gaps (not numbered) at the lateral edges thereof, thus, the projections are fitted into the gaps for locating the pads 3 in proper position when the pads 3 are fitted onto the elongated supporting portion 12. Furthermore, referring to FIG. 2, the pads 3 are shaped in such a manner that the outer sides thereof taper off towards an upper end thereof.

In combination, the elongated supporting portion 12 is joined to the connecting portion 11 with the pads 13 being inserted into the first and the second through holes 1122, 1131 to contact the annular walls 1123, 1132. Therefore, weight of the table's top portion and objects on the top portion is supported on the pads 3 alone.

Thus, the elongated supporting portion 12 can be forced further into the connecting portion 11 when more weight is placed on the top portion of the table, allowing firmness of connection of the elongated supporting portion 12 to the connecting portion 11 to be increased.

Figure 3:
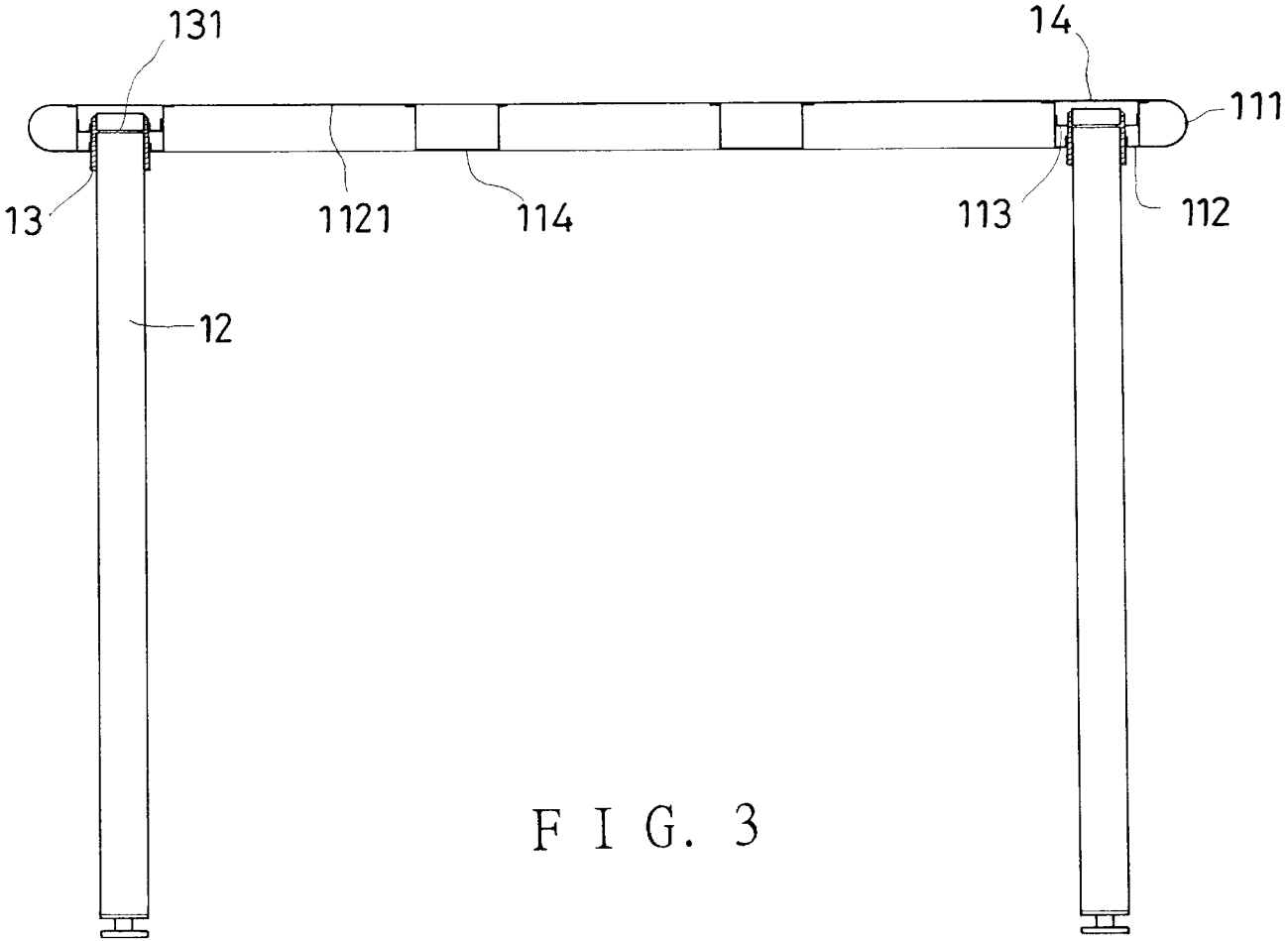
FIG. 3 is a side view of a table with the legs according to the present invention.
Figure 4:
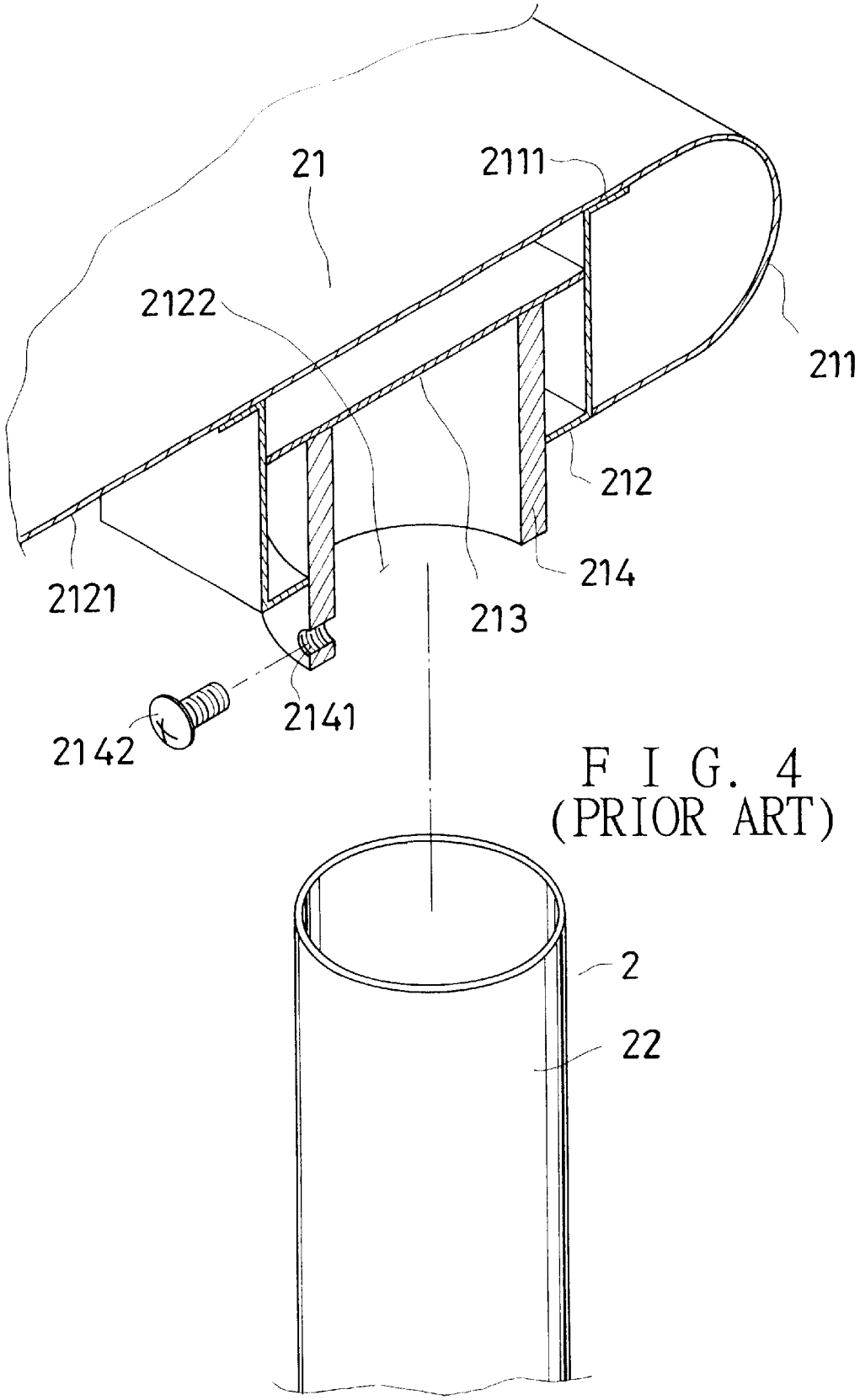
FIG. 4 (PRIOR ART)
FIG. 4 an exploded perspective view of the conventional leg of a table as described in the Background; and, FIG. 5 is a cross-sectional view of the conventional leg of a table.

Referring to FIG. 3, which shows a second embodiment of the present invention, several second supports 114 are provided to the bottom side of the table's top portion for helping increase strength of the table; each of the second support 114 has two lateral support plates, and a horizontal portion formed between lower ends of the lateral support plates thereof. The lateral support plates of the second supports 114 are joined to the top portion's bottom side by means of welding.

From the above description, it can be easily understood that the leg of a metallic table of the present invention has advantages as followings:

1. Because the pads are inserted into the annular walls of the connecting portion 11 in a secure manner, the table is relatively steady and firm.
2. The pads 3 will be forced further into the connecting portion 11 when more weight is placed on the top portion of the table. Therefore, there is desirable firmness in connection of the elongated supporting portion 12 to the connecting portion 11, and the table will be even more stable when heavy weight is placed on the top portion.

What is claimed is:

1. A metallic table having at least one leg, comprising:

(a) a table top portion with a top side, a bottom side and an edge;

(b) a connecting portion, the connecting portion including:

(i) a support having at least two lateral plate portions fixedly joined to the bottom side of the table top portion near the edge; a horizontal portion between the lower ends of the lateral plate portions thereof; the horizontal portion having a first through hole; and a first annular wall disposed around the first through hole of the horizontal portion;

(ii) a connecting unit disposed between, and securely joined to, the lateral plate portions of the support above the horizontal portion; the connecting unit having a second through hole aligned with the first through hole; and a second annular wall disposed around the second through hole;

(c) an elongated supporting portion having at least two pads with an upper and lower end which are fitted around an upper end of the elongated supporting portion; the elongated supporting portion being joined to the connecting portion with the pads being inserted into the first and the second through holes to contact the first and second annular walls;

the pads being tapered towards the upper end thereof;

the first and the second annular walls being shaped so that the inner sides of the annular walls taper in towards an upper end of the second annular wall;

whereby the elongated supporting portion is forced further into the connecting portion when increasing the weight on the table top portion thereby increasing the firmness of the connection between the table top portion and the connecting portion, and the elongated supporting portion.

2. The metallic table having at least one leg as recited in claim 1, comprising a plurality of second supports each having at least two lateral support plates which are fixedly joined to the bottom side of the top side of the table top portion; the second supports each having a horizontal portion between the lower ends of the lateral support plates of the second support.

3. The metallic table having at least one leg as recited in claim 1, wherein the pads have protruding lines on inner sides, and the elongated supporting portion has an annular trench on the upper end of the elongated supporting portion; the protruding lines being fitted into the annular trench.

4. The metallic table having at least one leg as recited in claim 1, wherein the pads have projections, and gaps at lateral edges thereof; the projections being fitted into the gaps for locating the pads when the pads are fitted onto the elongated supporting portion.

* * * * *